US006659432B2

(12) United States Patent
Nickel

(10) Patent No.: US 6,659,432 B2
(45) Date of Patent: Dec. 9, 2003

(54) CARBURETOR ARRANGEMENT

(75) Inventor: Hans Nickel, Cottenweiler (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 10/066,742

(22) Filed: Feb. 6, 2002

(65) Prior Publication Data

US 2002/0109244 A1 Aug. 15, 2002

(30) Foreign Application Priority Data

Feb. 12, 2001 (DE) ..... 101 06 364

(51) Int. Cl.[7] ..... F02M 1/02

(52) U.S. Cl. ..... 261/64.1; 55/385.3; 55/DIG. 28; 251/298; 261/64.6

(58) Field of Search ..... 261/64.6, 64.1; 55/385.3, 358.7, 417, DIG. 28; 251/298; 123/198 E

(56) References Cited

U.S. PATENT DOCUMENTS 755,284 A * 3/1904 Dixon ..... 251/298
995,110 A * 6/1911 Bellows ..... 251/298
3,342,465 A * 9/1967 Szwargulski et al. ..... 261/52
3,726,511 A * 4/1973 Jones ..... 261/39.3
4,190,074 A * 2/1980 Mailliet et al. ..... 137/315.16
4,460,011 A * 7/1984 Huber, Jr. ..... 137/375
4,834,784 A * 5/1989 Bidanset ..... 55/385.7
4,888,034 A * 12/1989 Koga ..... 96/367
5,103,781 A * 4/1992 Scott et al. ..... 123/179.18
5,174,255 A * 12/1992 Collins et al. ..... 123/179.1

* cited by examiner

*Primary Examiner*—Richard L. Chiesa
(74) *Attorney, Agent, or Firm*—Walter Ottesen

(57) ABSTRACT

The invention relates to a carburetor arrangement for an internal combustion engine (1), especially for a drive motor of a work apparatus such as a motor-driven chain saw, a brushcutter, a cutoff machine or the like. The carburetor arrangement includes a carburetor (2) having an intake channel (3) and an air filter (4) mounted upstream of the intake channel (3). The air filter (4) has an air filter housing (5). The intake channel (3) opens with an intake opening (6) in a housing base (7) of the air filter housing (5). The intake opening (6) can be covered at least partially by a choke element (8). The choke element (8) is held on a choke carrier (9) so as to permit a limited movement of the choke element.

20 Claims, 2 Drawing Sheets

CARBURETOR ARRANGEMENT

BACKGROUND OF THE INVENTION

Work apparatus having an internal combustion engine as a drive motor include a carburetor for generating an air/fuel mixture which is so adjusted that the air/fuel ratio is optimal for the running of the engine in the operationally warm condition. The work apparatus can include, for example, a motor-driven chain saw, a brushcutter, a cutoff machine or the like. For a cold start, however, a part of the fuel of the air/fuel mixture condenses on the cold walls of the engine and, as a consequence thereof, the air/fuel mixture is too lean. As a consequence, the engine does not start or starts only poorly.

A choke element is widely used for improving the cold start performance. With the choke element, the intake channel of the engine is partially closed in the region of the carburetor in such a manner that an enrichment of the air/fuel mixture occurs.

In a great many known carburetor configurations, a choke flap is integrated into the carburetor, which, however, requires a considerable constructive complexity. In other known configurations, a choke element is provided outside of the carburetor in the region of the intake opening in the air filter housing which lies upstream of the intake channel. This choke element, for example, can be pressed against the intake opening with a pivot arm. Here, a precise seating of the choke element on the intake opening is required for a precise reproducibility of the adjustment conditions for the cold start. The external arrangement of the choke element and especially its journaling, for example, on a wall of the forward-mounted air filter housing, can lead to tolerance problems. As a consequence of these tolerance problems, the choke element lies, in the closed state, with inadequate sealing in the region of the intake opening.

SUMMARY OF THE INVENTION

It is an object of the invention to provide a carburetor arrangement with improved insensitivity to tolerances in the region of the choke element.

The carburetor arrangement of the invention is for an internal combustion engine including an engine of a work apparatus including a motor-driven chain saw, brushcutter, cutoff machine or the like. The carburetor arrangement includes: a carburetor defining an intake channel; an air filter housing including an air filter arranged upstream of the intake channel; the air filter housing having a base wall defining an intake opening communicating with the intake channel; and, a choke assembly including: a carrier; a choke element arranged on the carrier so as to permit the choke element to at least partially cover the intake opening; and, means for holding the choke element so as to permit limited relative movement thereof.

In the above, the choke element is held on a separate choke carrier. The mounting of the choke carrier is designed for limited movement. The limiting of the movability leads to a coarse alignment of the choke element with respect to the intake opening. The mobility itself makes possible an automatic adaptation of the position of the choke element relative to the intake opening. As a practical matter, the movable mounting is so configured that the choke element is laterally displaceable on the choke carrier in a direction, which lies in the plane of the intake opening, and is laterally displaceable preferably in desired directions lying in the above-mentioned plane. Position tolerances, which lie laterally and in elevation, can, in this way, be compensated in a simple manner without a costly highly precise manufacture being necessary.

In an advantageous further embodiment of the invention, the choke element is pivotally held about one and preferably about any number of axes lying in the plane of the intake opening. In this way, angle tolerances between the plane of the choke element and the plane of the intake opening are automatically compensated. Accordingly, the complexity of an excessively high-precision manufacture is unnecessary.

In addition to the compensation of manufacturing tolerances, the above mentioned embodiments also easily make possible a compensation of, for example, thermal expansions, even, under some circumstances considerable, thermal expansion of an air filter housing, which is made of plastic and on which the choke carrier is journalled with the choke element.

In a practical further embodiment of the invention, a guard to prevent rotation or twisting of the choke element with respect to the longitudinal axis of the intake channel is provided. Especially in connection with aerodynamic ancillary devices (such as form bodies or air bores on the choke element), the alignment of the ancillary devices with respect to the carburetor is ensured.

The above-described connection of the choke element to the choke carrier provides for limited movement and is easily realizable by means of a snap connection having play. The constructive and manufacturing complexity is low and a limited movement in the above-described degrees of freedom is made possible in a simple manner in a corresponding configuration of the play. The snap connection additionally permits a rapid and cost-effective assembly.

In a constructively simple and effective embodiment of the snap connection, the choke element has a latch lug which can latch into a corresponding latch clamp of the choke carrier. A holding hook is advantageously provided on the latch lug and this holding hook engages behind an edge of the choke carrier in the assembled condition and thereby reliably prevents an axial slippage of the latch lug out of the latch clamp without affecting the assembly operation. The latch hook is advantageously so configured that it permits a limited axial play.

To simplify the assembly operation, the latch clamp has at least one assembly bevel whereby the latch clamp is automatically widened when the latch lug is introduced so that the latch lug can snap into the latch clamp. The above-described protection against rotation or twisting is constructively simply configured in that a holding lug is provided on the choke element at a radial spacing to the snap connection. The holding lug engages in a corresponding receptacle opening on the choke carrier.

To achieve a reliable and precise alignment of the choke element with respect to the intake opening to be covered, it is practical to provide a centering device by means of which the choke element is automatically aligned with respect to the intake direction. In a simple and effective embodiment, this automatic alignment is achieved in that a peripherally extending centering bevel, which is adapted to the contour of the intake opening, is provided on the choke element. The centering bevel can, for example, be in the form of a truncated cone. The peripherally extending centering bevel has an automatic centering action when the throttle element closes and furthermore forms a reliable self-adapting sealing seat for the choke element. In an advantageous variation, the intake opening has a rounded edge and the above-described centering bevel is configured as a concave chamfer. The rounded edge of the intake opening leads, in the opened state of the choke element, to a low intake flow resistance which contributes to improving the engine power. In the closed state of the choke flap, an areal contact engagement, and therefore a reliable seal, results from the connection of the rounded edge with the contact-engaging concave chamfer.

The choke carrier is advantageously configured as a pivot arm. With a simple pivot movement, the choke element is brought to the intake opening and only low tolerances must be compensated. The choke element is moved approximately in the direction of the channel axis especially with a pivot axis of the pivot arm which lies transversely to the longitudinal axis of the intake channel. In this way, a precise preadjustment is already provided and the centering bevel, which is described above, is cleanly introduced into the intake opening.

In a practical embodiment, the pivot arm is journalled in a wall of the air filter housing. This arrangement does not require a separate device for journaling and furthermore makes possible a common removal of the choke element with the air filter housing whereby the carburetor is, for example, exposed for service work with few hand motions.

The choke element is advantageously configured as an injection molded part and especially of plastic. In this way, complex shapes can be produced in a cost-effective manner under large-series manufacturing conditions, which, in combination with the tolerance insensitivity of the choke arrangement, leads to an excellent choke action in the closed state of the choke element and to a low intake resistance in the opened state.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
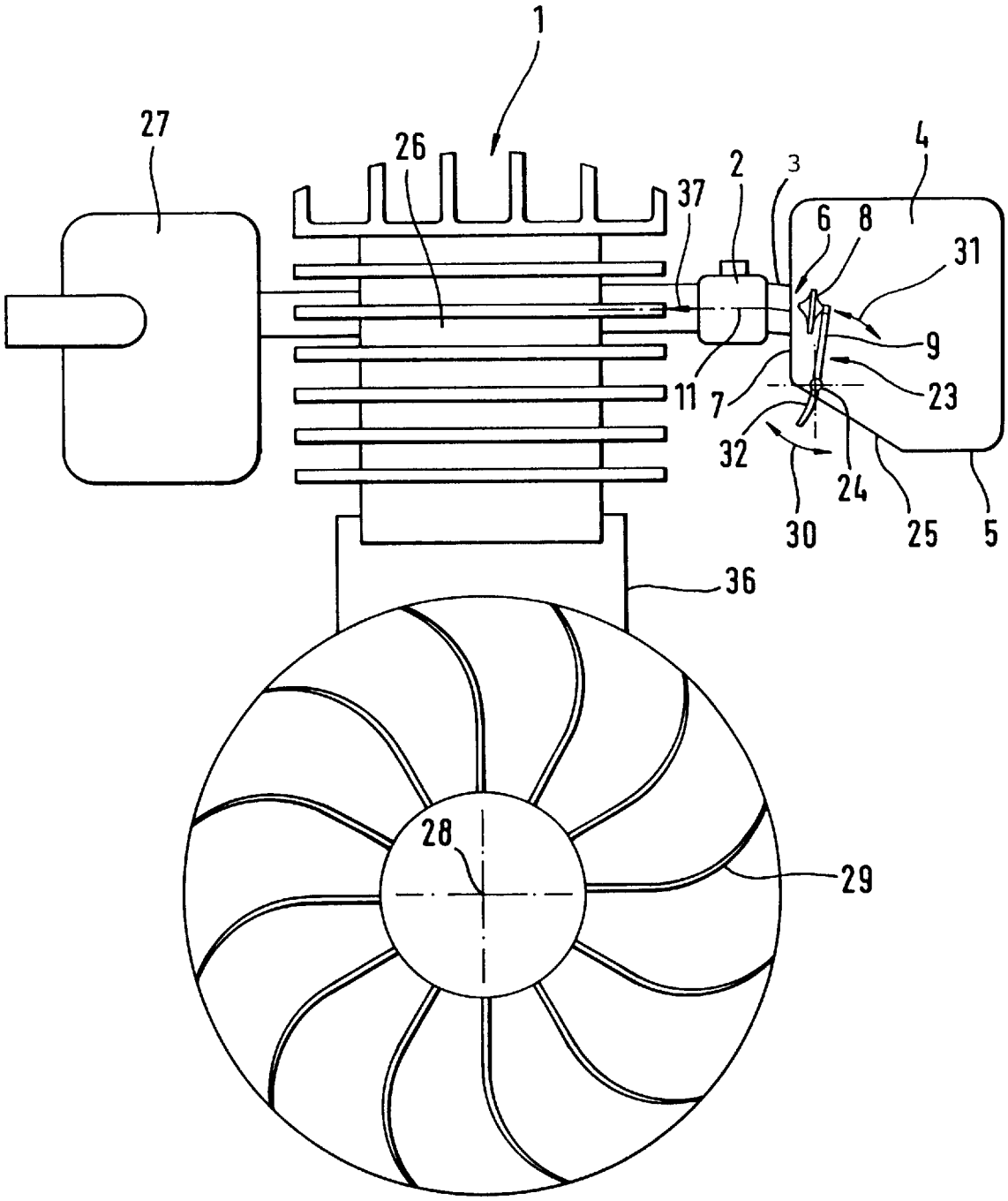
FIG. 1 is a schematic overview of an internal combustion engine having a choke element mounted in the air filter housing.

FIG. 1 shows an internal combustion engine 1 having a cylinder 26 and a motor housing 36. A crankshaft (not shown) rotates a fan wheel 29 about a crankshaft axis 28. On one side of the cylinder 26, an exhaust-gas muffler 27 and, on the opposite-lying side, a carburetor 2, are provided. The carburetor 2 supplies the engine 1 with an air/fuel mixture in the flow direction indicated by arrow 37. The carburetor 2 is connected via an intake channel 3 to an air filter 4. The intake channel 3 opens upstream (that is, against the direction identified by the arrow 37) with an intake opening 6 into a housing base 7 of the air filter housing 5. The intake opening 6 is at least partially closable by means of a choke element 8. For this purpose, the choke element 8 is pivotally guided on a choke carrier 9 in the form of a pivot arm 23. The pivot arm 23 is pivotally journalled about a pivot axis 24 and this axis lies transversely to the channel axis 11 of the intake channel 3. Outside of the air filter housing 5, the pivot arm 23 has an actuating lever 32. With the movement of the actuating lever 32 in the direction of the double arrow 30, the choke element 8 can be moved in the direction of double arrow 31, whereby the choke element 8 is pressed against the intake opening 6 or is lifted away from the intake opening 6. The choke element 8 can also be configured as a laterally pivotable slider with the pivot axis 24 lying approximately parallel to the channel axis 11. A linear or parallelogram-shaped displacement of the choke element 8 can also be provided.

Figure 2:
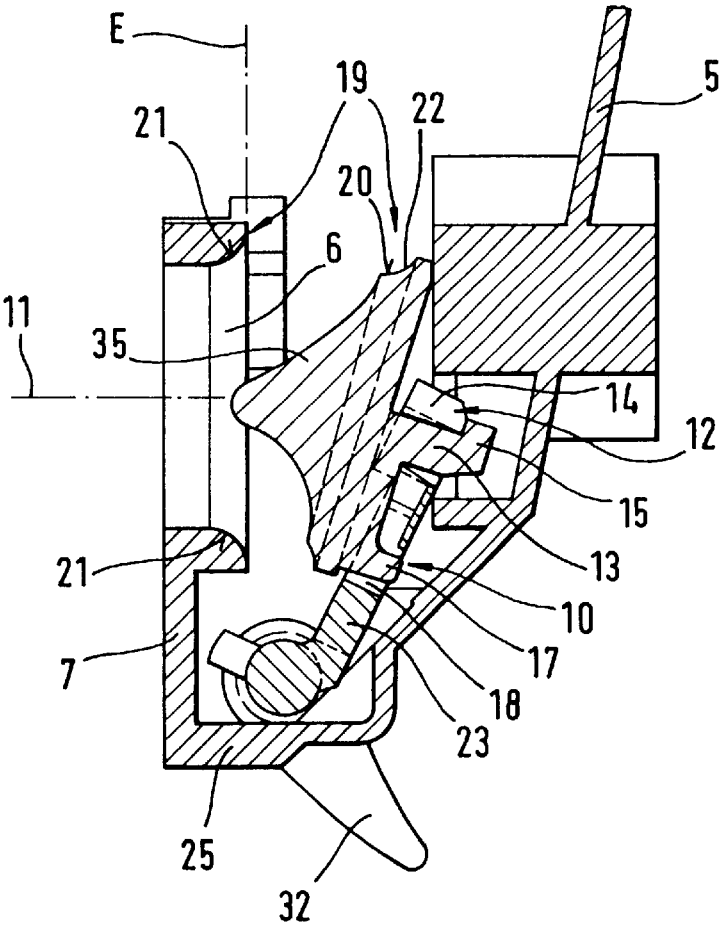
FIG. 2 is a detail enlargement of the arrangement of FIG. 1 in the region of the intake opening and of the choke element; and, FIG. 3 is a detail view of the pivot arm of FIG. 2 wherein the pivot arm carries the choke element.

FIG. 2 is an enlarged view and shows details of the arrangement of FIG. 1 in the region of the intake opening 6 and of the choke element 8. In the embodiment shown, the intake opening 6 has a circularly-shaped cross section in a plane E; however, another desired cross section can also be practical. A peripherally extending edge 21 of the intake opening 6 is configured so as to be rounded. In the embodiment shown, the region of the intake opening 6, the housing base 7 and the air filter housing 5 are all formed as one piece with a lower wall 25. However, a multi-piece configuration can also be practical. The pivot arm 23 for the choke element 8 is journalled on the air filter housing 5 about the pivot axis 24 in the region of the wall 25 and the actuating lever 32 extends out from the air filter housing 5.

On its side facing toward the intake opening 6, the choke element 8 has an aerodynamically shaped body 35. A centering bevel 20 is provided, which extends about the choke element 8, and this centering bevel can have the form of a truncated cone and, in the embodiment shown, is a concave chamfer 22 adapted to the rounded edge 21. The rounded edge 21 and the concave chamfer 22 conjointly define an automatic centering device for aligning the choke element 8 relative to the intake opening 6.

The choke element 8 is fixed on the choke carrier 9 by means of a snap connection 12 having play associated therewith. With this configuration, a journaling of the choke element 8 providing limited movement results with respect to a linear displaceability in all directions lying in the plane E of the intake opening 6 as well as a limited pivotability about desired axes lying in the plane E. Depending upon the application, a limiting of the degree of freedom of movement can be practical, for example, by the arrangement of a pivot axis or cardan joint or a linear guide.

A guard 10 is provided for aligning the choke element 8 having an aerodynamically shaped body 35 with respect to the intake opening 6. In the embodiment shown, this guard 10 comprises a holding lug 17 on the choke element 8 and a receiving opening 19 on the choke carrier 9 for the holding lug 17. The holding lug 17 is radially spaced relative to the snap connection 12. With this arrangement, a rotation or twisting of the choke element 8 relative to the channel axis 11 is prevented.

In the embodiment shown, the snap connection 12 comprises a latch lug 13 on the choke element 8 with the latch lug being held in a latch clamp 14 described in greater detail below.

The latch lug 13 includes a holding hook 15 at its end facing away from the choke element 8. The holding hook 15 engages, with play, behind the pivot arm 23 in the region of the latch clamp 14 and, in this way, permits a limited axial movability while simultaneously preventing the latch lug from slipping out. The choke element 8 with its aerodynamically shaped body 35 is manufactured as one piece with the latch lug 13, the holding hook 15 and the holding lug 17 utilizing injection molding. Depending upon the application, a configuration in cast metal or as a machined part can also be practical.

Figure 3:
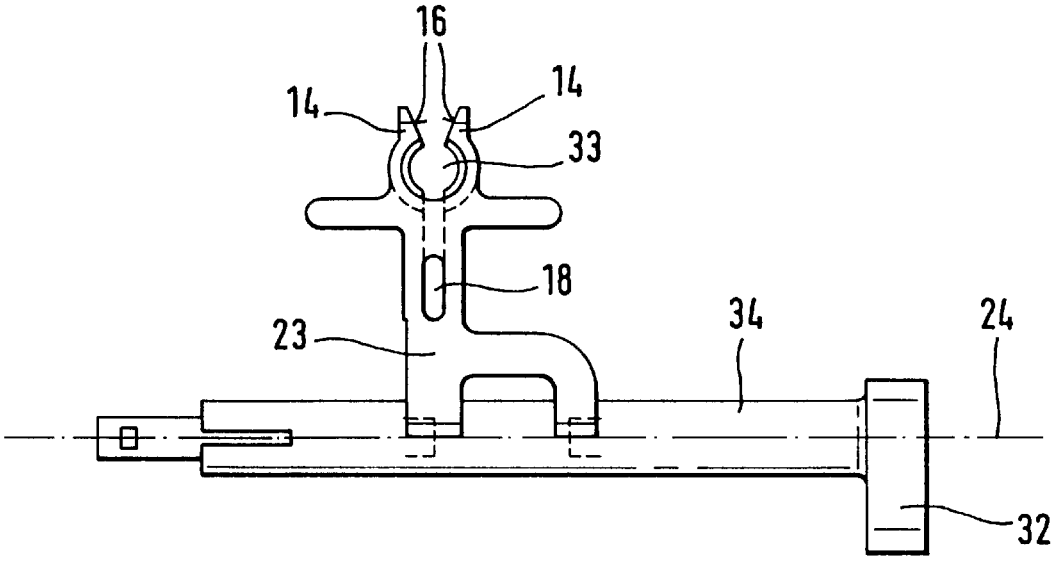

FIG. 3 shows details for the pivot arm 23 of FIG. 2 formed as a single piece. The pivot arm 23 includes a lever shaft 34 having an end on which the actuating lever 32 is formed for pivoting about the pivot axis 24. The receiving opening 18 in the form of a slot is arranged in the pivot arm 23 for receiving the holding lug 17 (FIG. 2). In the region of the free end of the pivot arm 23, an approximately cylindrical latch opening 33 is provided for receiving the latch lug 13 (FIG. 2). The diameter of the latch opening 33 is greater than the diameter of the latch lug 13 whereby a defined journaling with play results. The latch opening 33 is fork shaped in the direction of the free end of the pivot arm 23 and includes latch clamps 14 on respective sides and each latch clamp 14 has an inwardly directed assembly bevel 16.

It is understood that the foregoing description is that of the preferred embodiments of the invention and that various changes and modifications may be made thereto without departing from the spirit and scope of the invention as defined in the appended claims.

What is claimed is:

1. A carburetor arrangement for an internal combustion engine including an engine of a work apparatus including a motor-driven chain saw, brushcutter or cutoff machine, the carburetor arrangement comprising:

a carburetor defining an intake channel;

an air filter housing including an air filter arranged upstream of said intake channel;

said air filter housing having a base wall defining an intake opening communicating with said intake channel; and, a choke assembly including: a carrier; a choke element arranged on said carrier so as to permit said choke element to at least partially cover said intake opening; and, connecting means for connecting said choke element to said carrier so as to permit a limited movement of said choke element relative to said carrier.

2. The carburetor arrangement of claim 1, wherein said intake opening defines a plane; and, said choke element on said carrier is mounted so as to be laterally displaceable in a direction lying in said plane.

3. The carburetor arrangement of claim 2, wherein said choke element is laterally displaceable in said plane.

4. The carburetor arrangement of claim 1, wherein said intake opening defines a plane; said choke assembly defining a pivot axis in said plane; and, said choke element is held so as to be pivotable about said axis.

5. The carburetor arrangement of claim 1, wherein said choke opening defines a plane; and, said choke element is held so as to be pivotable about any desired axis in said plane.

6. The carburetor arrangement of claim 1, wherein said intake channel defines a channel axis and said choke assembly includes guard means for preventing a rotation or twisting of said choke element relative to said channel axis.

7. The carburetor arrangement of claim 6, wherein said connecting means comprises a snap connection for connecting said choke element to said carrier so as to permit said limited movement therebetween.

8. The carburetor arrangement of claim 7, wherein said snap connection includes a latch lug on said choke element and a latch clamp on said carrier for receiving and latchably holding said latch lug therein so as to permit said play therebetween.

9. The carburetor arrangement of claim 8, wherein said latch lug includes a hook formed thereon for holding said latch lug in said latch clamp to prevent said latch lug from axially separating from said latch clamp.

10. The carburetor arrangement of claim 9, wherein said latch clamp includes an assembly bevel to facilitate connecting said latch lug to said latch clamp.

11. The carburetor arrangement of claim 7, wherein said guard means comprises: a holding lug formed on said choke element at a radial spacing from said snap connection; and, a receiving opening on said choke carrier for receiving said holding lug therein.

12. The carburetor arrangement of claim 1, further comprising centering means for aligning said choke element with respect to said intake opening.

13. The carburetor arrangement of claim 12, wherein said centering means comprises: a contour formed on said base wall delimiting said intake opening; and, a centering bevel formed on said choke element adapted to said contour.

14. The carburetor arrangement of claim 13, wherein said contour formed on said base wall is a rounded contour; and, said centering bevel is formed as a concave chamfer.

15. The carburetor arrangement of claim 1, wherein said intake channel defines a channel axis; and, said carrier is formed as a pivot arm pivotable transversely to said channel axis.

16. The carburetor arrangement of claim 15, wherein said pivot arm is pivotally journalled in a wall of said air filter housing.

17. The carburetor arrangement of claim 1, wherein said choke element is an injection molded form part.

18. The carburetor arrangement of claim 17, wherein said injection molded form part is made of plastic.

19. A carburetor arrangement for an internal combustion engine including an engine of a work apparatus including a motor-driven chain saw, brushcutter or cutoff machine, the carburetor arrangement comprising:

a carburetor defining an intake channel;

an air filter housing including an air filter arranged upstream of said intake channel;

said air filter housing having a base wall having an intake opening communicating with said intake channel; and, a choke assembly including: a choke element; a carrier holding said choke element and said carrier being mounted in said air filter so as to be movable in a plane traverse to said intake opening for bringing said choke element to and away from said intake opening; and, connecting means for connecting said choke element to said carrier so as to permit a limited movement of said choke element relative to said carrier to facilitate at least a coarse alignment of said choke element with said intake opening when said carrier is moved to bring said choke element to said intake opening so as to permit said choke element to close said intake channel to an extent desired.

20. The carburetor arrangement of claim 19, wherein said intake opening defines a plane; and, said choke element on said carrier is mounted so as to be laterally displaceable in a direction lying in said plane.

* * * * *